United States Patent [19]

Lapeyre

[11] Patent Number: 4,949,663

[45] Date of Patent: Aug. 21, 1990

[54] ELECTRO-MAGNETIC COUPLING FOR TOW BOAT AND BARGE

[75] Inventor: James M. Lapeyre, New Orleans, La.

[73] Assignee: The Laitram Corporation, Harahan, La.

[21] Appl. No.: 378,414

[22] Filed: Jul. 11, 1989

Related U.S. Application Data

[63] Continuation of Ser. No. 142,517, Nov. 1, 1988, Pat. No. 4,848,259.

[51] Int. Cl.[5] ..... B63B 21/62

[52] U.S. Cl. ..... 114/246; 114/249; 114/251

[58] Field of Search ..... 114/230, 242, 249, 222, 114/246

[56] References Cited

U.S. PATENT DOCUMENTS

| | | | |
|---|---|---|---|
| 3,777,834 | 12/1973 | Hiraoka et al. | 114/222 |
| 3,974,794 | 8/1976 | Kakitani et al. | 114/230 |
| 4,449,471 | 5/1984 | van Roon | 114/249 |

FOREIGN PATENT DOCUMENTS

| | | | |
|---|---|---|---|
| 893685 | 1/1982 | U.S.S.R. | 114/230 |
| 1092088 | 5/1984 | U.S.S.R. | 114/230 |
| 1281474 | 1/1987 | U.S.S.R. | 114/230 |

*Primary Examiner*—Sherman D. Basinger
*Assistant Examiner*—Stephen P. Avila

[57] ABSTRACT

An electro-magnetic coupling apparatus for use with a tug and barge tow includes a bumper frame which is pivotally carried by the tub. The bumper frame includes a bearing surface that is positioned to bear against the barge so that a load transfer between the tub and the barge occurs at the bearing surface. A magnetic coupling preferably in the form of a plurality of coil members is carried at the load transfer surface for developing a magnetic field which can form a connection between the barge and the tug. An electrical power source is carried by the tub for energizing the magnetic field and a powered guide comprising a powered sheave and a pair of lines extending from the sheave to the barge defines a steering mechanism for angling the bumper frame and tug with respect to each other when maneuvering to each barge while making up a tow of several barges, for example.

10 Claims, 2 Drawing Sheets

ELECTRO-MAGNETIC COUPLING FOR TOW BOAT AND BARGE

This is a continuation of copending application Ser. No. 07/142,517, filed Jan. 11, 1988.

BACKGROUND OF THE INVENTION

The present invention relates to barge and tug connection systems, and more particularly relates to an electro-magnetic coupling apparatus for coupling a tug and barge to expedite barge handling while making up tows. An articulating bumper carries a magnetic field and wherein surfaces are adjustably carried by the bumper to conform to the surface of the barge.

One of the most common methods of moving cargo upon a river or ocean is the combination of a pushing or tow vessel commonly referred to as a "tug" which is joined to one or more elongated rectangular vessels known as barges. A very large number of barges are often connected end-to-end and side-to-side to form a very large tow with the tug usually being positioned at the rear of the tow so that the engines of the tug can push the entire assembly. One of the problems with large tows of this type is the problem of manipulating individual barges while the tow is being made up. This normally requires much skilled and dangerous hand work in tying and untying individual barges onto smaller tug boats which are used to assemble the barges into a large tow which is then propelled by very large tow boats.

Numerous barge and tug constructions have been patented wherein the problem of forming an adequate and structurally sound connection between the tug and the barge are of primary concern. Many of the systems that have been patented discuss a particular alignment of the tug and barge so that a slot or recess is provided on the barge into which the tug registers. Examples of such an arrangement can be seen, for example, in the Ocho U.S. Pat. No. 344,173, the Hooper U.S. Pat. No. 3,735,722, the Bloodworth U.S. Pat. No. 4,013,032, and the Fletcher U.S. Pat. No. 4,168,672.

Some patented barge and tug systems have used an interlocking or coupling arrangement wherein parts on the barge couple with parts on the tug to complete a connection. The Thompson U.S. Pat. No. 3,430,601 entitled "Barge Coupling Assembly" illustrates a coupling arrangement between barges while the Clemence, Jr. U.S. Pat. No. 3,756,183 entitled "Apparatus For Articulated Tow Boat Barge Combination" shows a pin and notch arrangement between a tug and barge. The Yamaguchi U.S. Pat. No. 3,844,245 entitled "Means Of Connecting Pusher Boat and Barge" show an interlocking arrangement between the tug and barge in combination with a V-notch. A similar interlocking connection is seen in the Ono U.S. Pat. No. 3,910,219 entitled "Connecting Structure For Oceangoing Push Barge." A flexible articulated connection is seen in the Bloodworth U.S. Pat. No. 3,922,993 while the Yamaguchi U.S. Pat. No. 3,935,831 shows a pair of powered pins which connect with notches on the barge. A coupling that includes a pinching arrangement is seen in the Bloodworth U.S. Pat. No. 4,148,270.

Several coupling arrangements for barges and tugs include the use of multiple winches and winch cables, some of which are designed to assist in steering of the vessels. An example is the Mosvo U.S. Pat. No. 3,461,829 entitled "System and Apparatus For Connecting and Steering Pushed Vessels." Various other patents which describe different types of cable and winch arrangements for coupling a tug to a barge can be seen, for example, in the Lunde U.S. Pat. No. 3,645,225, the Derecktor U.S. Pat. No. 3,651,778, the Lucht U.S. Pat. No. 3,804,052, the Kikui U.S. Pat. No. 3,842,781, the Janssen U.S. Pat. No. 3,882,813, the Harms U.S. Pat. No. 4,023,519, and the Zbilut et al. U.S. Pat. No. 4,026,234.

SUMMARY OF THE INVENTION

The present invention is an improvement of these prior art systems for coupling a tug and barge in that a bumper forms an articulated connection with the tug, the bumper carrying an array of magnetic coil members, each of which is movably connected to the bumper so that each magnetic coil member can independently conform to the hull of a barge being handled or moved. The bumper is movably mounted with respect to the tug about a vertical axis such as, for example, by using a pivot so that the entire barge bumper can be rotated for use in turning. A pair of guide lines powered by a winch or sheave, for example, can be used to apply tensile load to opposite end portions of the barge bumper so that it can be rotated about the pivot during operation. The magnetic coils can be remotely powered from the tug so that disconnection could be immediately made if desired.

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF A PREFERRED EMBODIMENT

Figure 1:
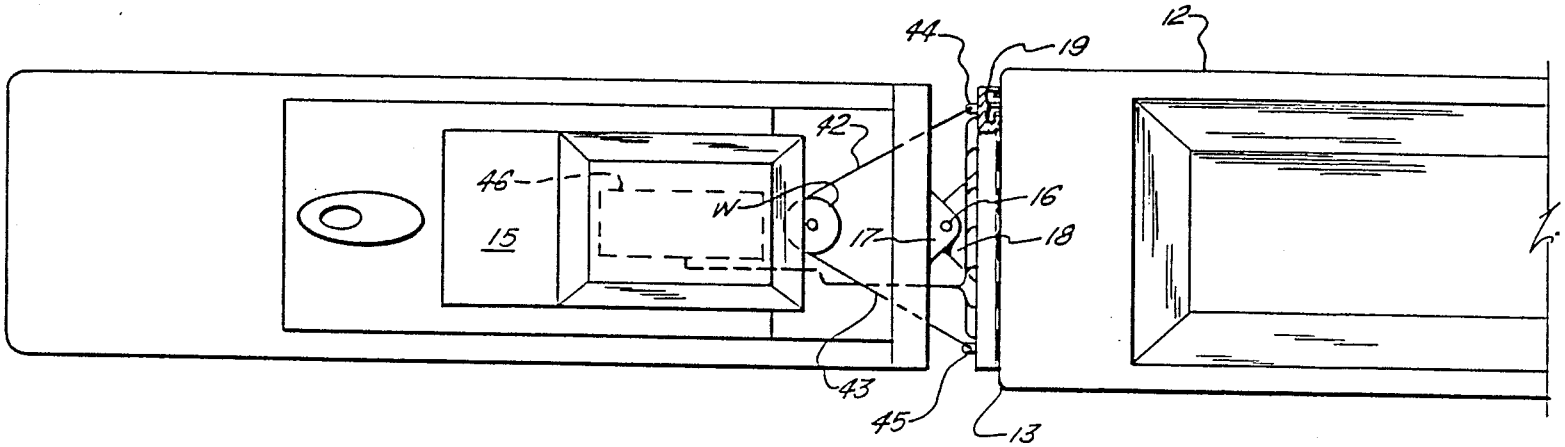
FIG. 1 is a top view of the preferred embodiment of the apparatus of the present invention.
Figure 2:
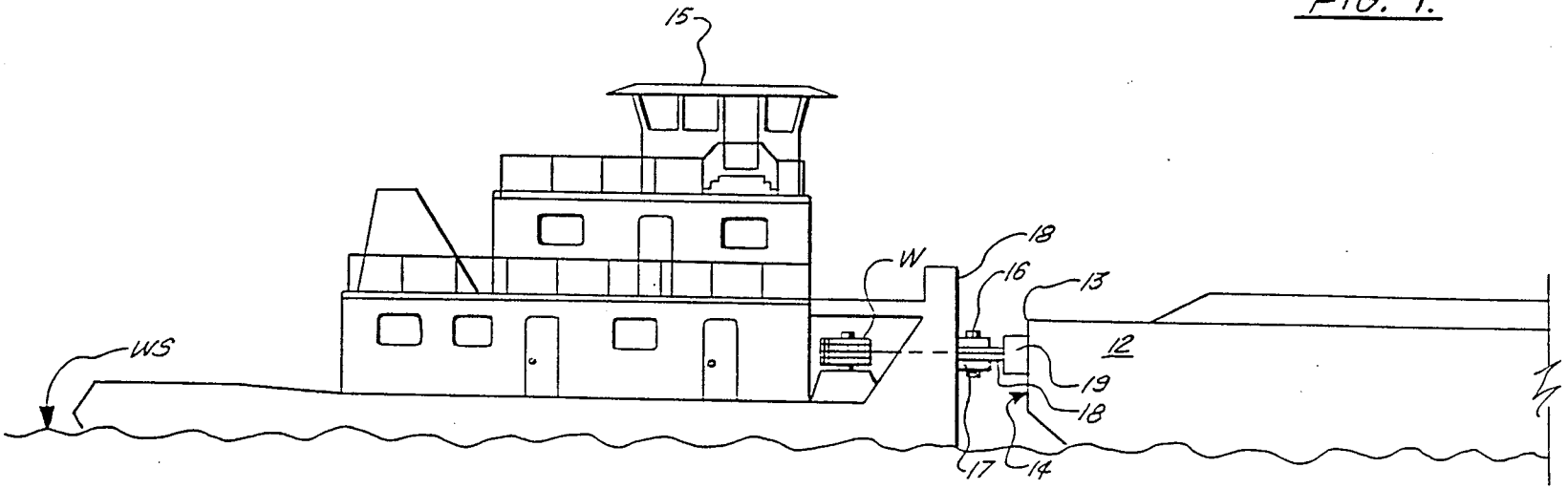
FIG. 2 is an elevational view of the preferred embodiment of the apparatus of the present invention.
Figure 3:
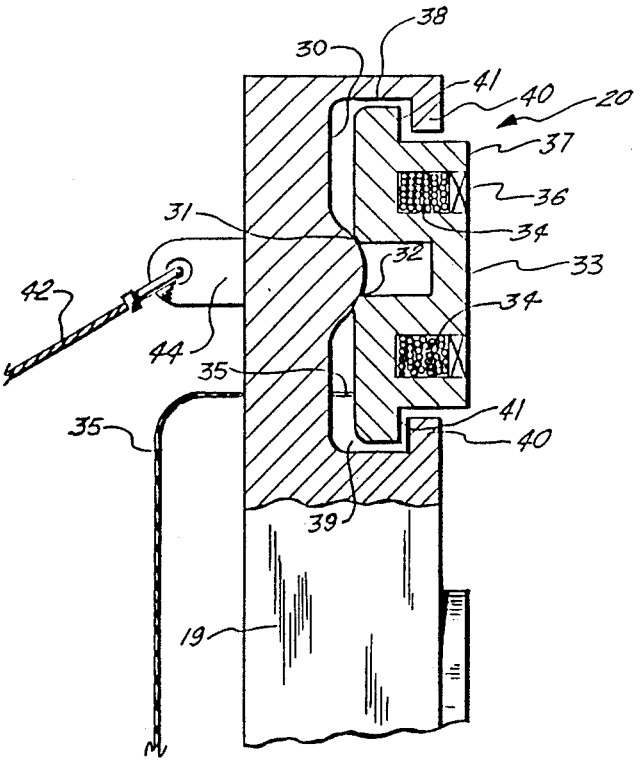
FIG. 3 is an enlarged fragmentary view illustrating the magnetic coil members and the bumper portions of the present invention.
Figure 4:
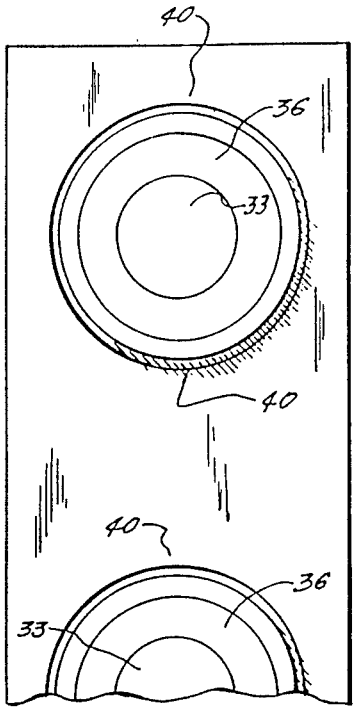
FIG. 4 is a sectional view taken along lines 3—3 of FIG. 3.

FIGS. 1–4 illustrate generally the preferred embodiment of the apparatus of the present invention designated generally by the numeral 10. In FIGS. 1 and 2, there can be seen a common barge 12 having a stern 13 end portion which is substantially flat, thus providing a surface 14 that can be abutted by the tug 15. The barge 15 would typically be manufactured of welded steel, and thus magnetism can be used to form a connection with the steel hull. It should be understood, however, that barge 15 could be wooden or concrete, for example, having steel plated end and/or side portions.

In FIG. 2, WS designates the water surface upon which tug 15 and barge 12 are floating. Tug 15 is equipped with a forward pivot pin 16 connecting gussets 17, 18. Gussets 17, 18 can pivot with respect to each other about pivot pin 16 during turning of the assembly of barge 12 and tug 15. Gusset 17 would be welded, for example, to the forward pushing surface portion of tug 15 which is a substantially flat vertical plane as best seen in FIGS. 1 and 2. A barge bumper 19 is carried by gusset 18. Bumper 19 is rectangular and includes preferably a plurality of forwardly facing open ended sockets 20.

Each socket 20 includes a rear surface 30 having a curved 31 portion which is convex and which cooperates with a correspondingly curved concave rear surface 32 provided on magnetic coil member 33. Coil member 33 includes a coil 34 which is electrically activated to produce a magnetic field by means of power supply line 35. Coil 34 would be insulated from forward bearing surface 37 of each coil member 33 with a non-magnetic filler 36. Forward bearing surface 37 is a substantially flat and forward facing surface that abuts the surface 14 of barge 12 during operation.

Each socket 20 includes a peripheral wall 38 which is spaced from coil member 33 so that an air space 39 is positioned between wall 38 and member 33. This space 39 thus produces a slackness which allows the coil member 33 to articulate and move within socket 20 with the surface 32 bearing against the surface 31 during operation and during such articulation. Each coil member 33 is maintained within its respective socket 20 by means of an annular shoulder 40 which cooperates with a similar annular shoulder 41 provided on the side of coil member 33. Notice that the shoulder 40 defines an opening that is smaller in section than the sectional dimensions of annular shoulder 41.

A structural guideline includes port 42 and starboard 43 portions which attach respectively to bumper 12 at structural eyelets 44, 45. Guideline 42, 43 is frictionally wound about winch W so that rotation of the winch can apply tension to either port or starboard guideline 42 or 43. Thus, tension applied to line 42 pivots tug 15 and bumper 19 with respect to each other which helps "make up" a connection between bumper 19 and barge 15. This ability to pivot bumper 19 with respect to barge 15 is particularly useful in making up a tow when wind or current is strong for example or where maneuvering room is limited.

A power source 46 is provided on tug 15 which can be operated by the pilot of the tug or by the tug's crew for activating and deactivating coils 33 and thus the magnetic field which is used to adhere bumper 19 to the rear surface 14 of tug 12. Normally, the hull of barge 15 is designed to be pushed, not pulled, by a tug. Thus, the apparatus 10 of the present invention is primarily used to properly align and preliminarily attach the barge 15 and tug 12 together. Tug 12 then pushes the barge to its destination.

The foregoing description of the invention is illustrative and explanatory thereof, and various changes in the size, shape and materials, as well as in the details of the illustrated construction may be made without departing from the spirit of the invention.

What is claimed as invention is:

1. An electro-magnetic coupling apparatus for a tug boat and barge tow comprising:

(a) a bumper frame carried by the tug boat and including a forwardly facing portion positioned to engage the barge;

(b) a plurality of bearing surfaces spaced along the bumper frame forwardly facing portion, each defining a separate load transfer surface between the tug boat and the barge;

(c) magnetic coupling means carried at each load transfer surface for developing a magnetic field which can form a tensile connection between the barge and tug at the bearing surface;

(d) power means for energizing the magnetic field; and (e) articulating means spaced laterally along the bumper frame forwardly facing portion for allowing movement between each bearing surface and the barge so that the bearing surfaces can separately and closely conform to the barge when the magnetic field is energized.

2. The apparatus of claim 1, wherein the frame includes at least one coil carriage movably mounted within the frame, the coil carriage including the bearing surface for abutting the barge.

3. The apparatus of claim 2 wherein the articulating means includes an articulating connection of the coil carriage with respect to the frame.

4. The apparatus of claim 1 further comprising a vertical pivotal connection which allows an angular displacement between the barge and tug during a tow such as when the barge and tug tow are turning.

5. The apparatus of claim 4 further comprising powered guide means for angling the barge and tug with respect to each other during a turning of the tow.

6. The apparatus of claim 1 further comprising a plurality of magnetic coils mounted in spaced arrangement along the bumper frame, each coil having a bearing surface positioned to bear against the barge and the coils being mounted in articulating connections with respect to the frame.

7. The apparatus of claim 1, wherein the frame includes at least one socket facing forwardly, a magnetic coil movably disposed within the socket having a forwardly facing bearing surface, and means for preventing removal of the coil from the socket in a forwardly direction.

8. The apparatus of claim 1 further comprising a plurality of sockets on the bumper frame, each socket having an opening that extends to the forward surface of the bumper frame, each of the sockets carrying a magnetic coil, the bearing surface comprising a forwardly facing bearing surface of each magnetic coil and each coil can articulate within the socket so that the forward bearing surface of each coil can move and conform to the surface of a barge independently of the other coils.

9. The apparatus of claim 5, wherein the powered guide means includes means, spaced laterally from the pivot for rotating the barge and tug with respect to each other about the pivot.

10. A coupling apparatus for a tug boat and barge tow comprising:

a. a bumper frame carried by the tug boat and including a bearing surface positioned to bear against a barge so that load transfer between the tug boat and the barge occurs at the bearing surface;

b. articulating means including an array of articulating members carried in a corresponding plurality of sockets for allowing movement between the bearing surface and the barge so that the bearing surface conforms to the barge;

c. magnetic coupling means carried at the bearing surface for developing a magnetic field which can form a tensile connection between the barge and tug at the bearing surface;

d. power means for energizing the magnetic field;

e. a vertical pivotal connection carried by the tug which joins the tug and bumper frame; and f. powered means extending to opposite sides of the bumper frame that includes independently operable cable portions which can be selectively tensioned to turn the barge and tug into either of left hand or right hand turning directions.

* * * * *